US007140753B2

(12) United States Patent
Wang et al.

(10) Patent No.: US 7,140,753 B2
(45) Date of Patent: Nov. 28, 2006

(54) WATER-COOLING HEAT DISSIPATION DEVICE ADOPTED FOR MODULIZED LEDS

(75) Inventors: Bily Wang, Hsin Chu (TW); Jonnie Chuang, Pan Chiao (TW); Heng-Yen Lee, Hsin Chu Hsien (TW)

(73) Assignee: Harvatek Corporation, Hsin Chu (TW)

( * ) Notice: Subject to any disclaimer, the term of this patent is extended or adjusted under 35 U.S.C. 154(b) by 0 days.

(21) Appl. No.: 10/915,539

(22) Filed: Aug. 11, 2004

(65) Prior Publication Data

US 2006/0034085 A1 Feb. 16, 2006

(51) Int. Cl.
*F21V 29/00* (2006.01)

(52) U.S. Cl. ..... 362/294; 362/218

(58) Field of Classification Search ..... 362/101, 362/218, 294, 373, 800; 165/80.4, 170, 171; 313/35, 36, 45, 46; 361/699, 701, 702, 703; 257/713, 714, 716

See application file for complete search history.

(56) References Cited

U.S. PATENT DOCUMENTS

| | | | | |
|---|---|---|---|---|
| 3,372,740 | A * | 3/1968 | Kastovich et al. | 362/294 |
| 5,791,770 | A * | 8/1998 | Hoyt et al. | 362/294 |
| 6,388,317 | B1 * | 5/2002 | Reese | 257/713 |
| 6,661,658 | B1 * | 12/2003 | Capriz et al. | 165/80.4 |
| 2005/0047140 | A1 * | 3/2005 | Chang | 362/800 |

* cited by examiner

*Primary Examiner*—Y. My Quach-Lee
(74) *Attorney, Agent, or Firm*—Troxell Law Office, PLLC

(57) ABSTRACT

A water-cooling heat dissipation device adopted for a lighting module that includes a plurality of LEDs modulized together, and includes a heat dissipation plate, at least one curved canal recessed inside the heat dissipation plate, at least one inlet formed on one of the sides of the heat dissipation plate selectively, and at least one outlet formed on one of the sides of the heat dissipation plate selectively. The curved canal created as a part of the heat dissipation plate runs laterally and includes at least one bending portion arranged thereon. The inlet and the outlet communicate with the bending portion and a free end of the curved canal in alternative manners, respectively. The lighting module contacts a top of the heat dissipation device directly.

3 Claims, 3 Drawing Sheets

WATER-COOLING HEAT DISSIPATION DEVICE ADOPTED FOR MODULIZED LEDS

BACKGROUND OF THE INVENTION

1. Field of the Invention

The present invention relates to a heat dissipation device, and particularly relates to a water-cooling heat dissipation device that can dissipate heat from modulized LEDs.

2. Background of the Invention

As technology develops, not only a single LED can be applied to electronic devices as indication lamps, but a plurality of LEDs can also be modulized instead of conventional lamps for lighting, advertising, large advertising displays or for indicating for traffic lights for example. An LED is a lighting device that is more efficient than a conventional lamp. It has low power consumption, is lightweight, has a long service life and so on. Nevertheless, a plurality of LEDs modulized together result in excessive heat due to the need for an individual current supply for each LED. The modulized arrangement of the LEDs retains the heat that should be dissipated to protect the LEDs. In addition, the LED is designed with high luminance to meet requirements, that means, besides the original characteristic of the single LED, the current supplied to the LED will rise correspondingly; the heat will be increased thereby, particularly to the modulized LEDs. Furthermore, too much heat will reduce the luminance.

A conventional method for dissipating heat from modulized LEDs is to enlarge a heat dissipation plate. This increases the direct contact area between the modulized LEDs and the heat dissipation plate. Furthermore, a fan providing an air-cooling function can be added. In addition to incurring further costs, significant heat still remains thereby reducing luminance.

Hence, an improvement over the prior art is required to overcome these disadvantages.

SUMMARY OF INVENTION

The primary object of the invention is therefore to specify a water-cooling heat dissipation device adopted for modulized LEDs, which can be manufactured by a simple process and at low cost, so as to increase the efficiency of heat dissipation, to avoid reducing the luminance of the LEDs and to guarantee a current-benefit ratio.

This objective is achieved by the invention by employing a water-cooling heat dissipation device adopted for a lighting module that includes a plurality of LEDs modulized together. The water-cooling heat dissipation device includes a heat dissipation plate, at least one curved canal recessed inside the heat dissipation plate, at least one inlet formed on one of the sides of the heat dissipation plate selectively, and at least one outlet formed on one of the sides of the heat dissipation plate selectively. The curved canal penetrates the heat dissipation plate laterally and includes at least one bending portion arranged thereon. The inlet and the outlet communicate with the bending portion and a free end of the curved canal in alternative manners, respectively. The lighting module contacts a top of the heat dissipation device directly.

To provide a further understanding of the invention, the following detailed description illustrates embodiments of the invention. Examples of the more important features of the invention have thus been summarized rather broadly so that the detailed description that follows may be better understood, and in order that the contributions to the art may be appreciated. There are, of course, additional features of the invention that will be described hereinafter and which will form the subject of the claims.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

The present invention provides a water-cooling heat dissipation device adopted for a lighting module that includes a plurality of LEDs modulized together, it also provides a water-cooling heat dissipation device that operates as part of a system that includes a heat-conductive liquid, a liquid passing pipe, a heat exchanger and a pump, so as to provide liquid circulation for heat dissipation.

Figure 1:
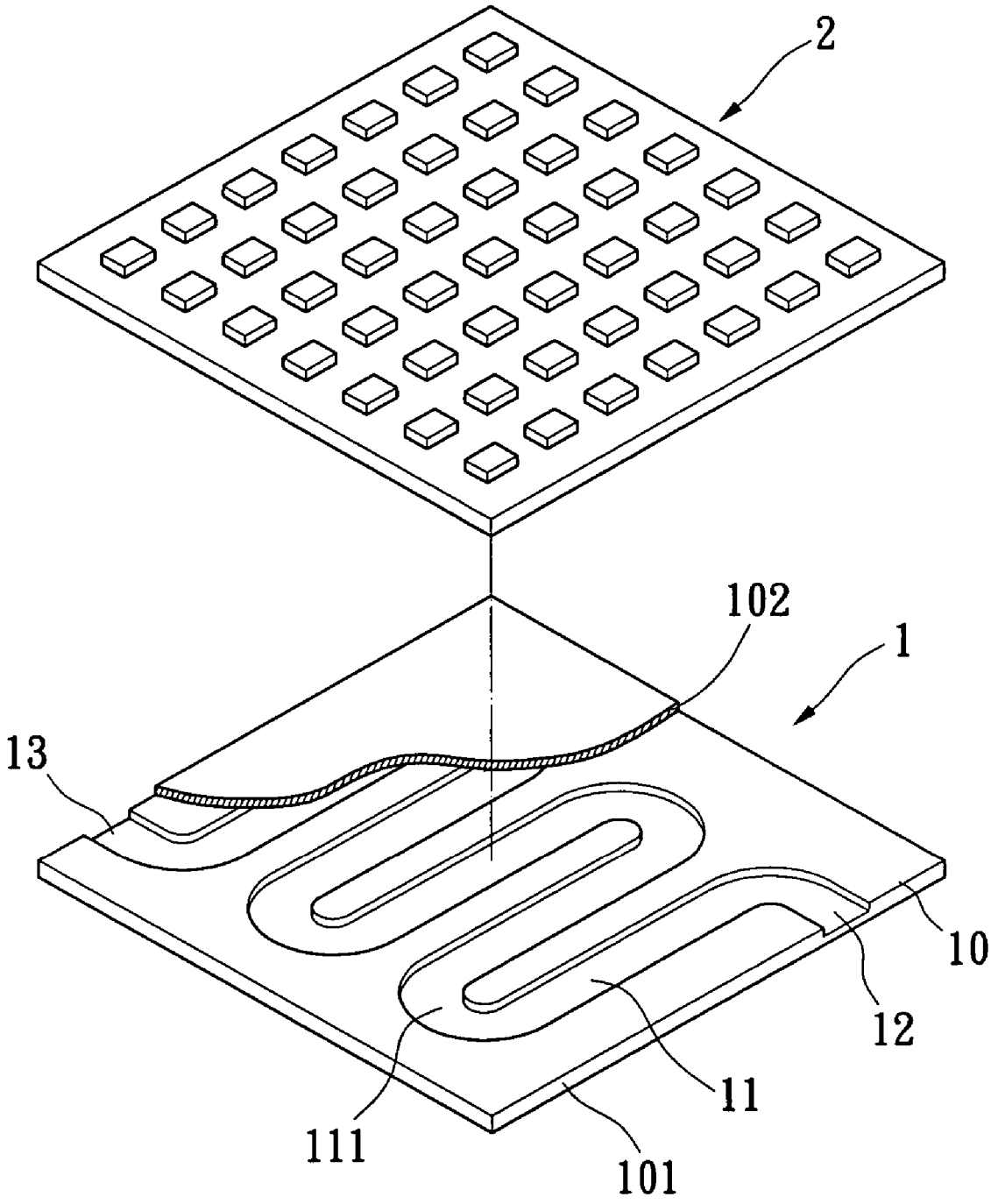
FIG. 1 is a perspective view of a water-cooling heat dissipation device adopted for modulized LEDs of a first embodiment according to the present invention.

With respect to FIG. 1, a first embodiment according to the present invention, a water-cooling heat dissipation device 1 is connected to a lighting module 2 that includes a plurality of LEDs modulized together. The water-cooling heat dissipation device 1 includes a heat dissipation plate 10, at least one curved canal 11 recessed inside the heat dissipation plate 10, at least one inlet 12 formed on one of the sides of the heat dissipation plate 10 selectively, and at least one outlet 13 formed on one of the sides of the heat dissipation plate 10 selectively. The curved canal 11 created as a part of the heat dissipation plate 10 running laterally and including at least one bending portion 111 arranged thereon. The curved canal 11 recessed inside the heat dissipation plate 10 contains the heat-conductive liquid passing therein. The inlet 12 communicates with the bending portion 111 and a free end of the curved canal 11 in an alternative manner. The outlet 13 communicates with the bending portion 111 and the free end of the curved canal 11 in the same way. The lighting module 2 is connected to the top of the heat dissipation device 1 directly.

The heat dissipation plate 10 can be made in an assembly manner or in an integral one-piece manner, and the heat dissipation plate 10 includes a body 101 having the curved canal 11, and a lid 102 covering the body 101 relatively. According to this embodiment, the heat dissipation plate 10 is made in the assembly manner.

Figure 2:
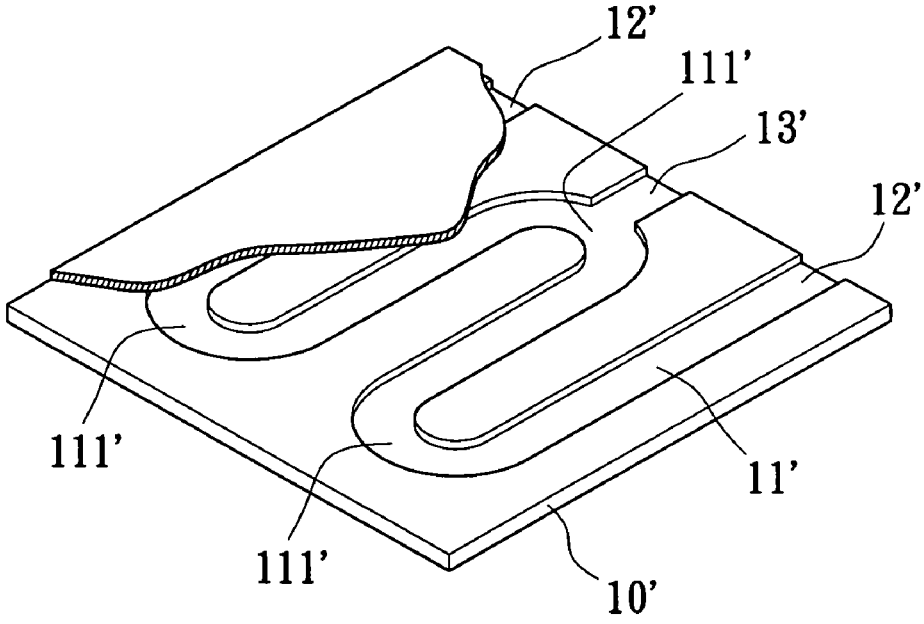
FIG. 2 is a perspective view of the water-cooling heat dissipation device adopted for modulized LEDs of a second embodiment according to the present invention.
Figure 3:
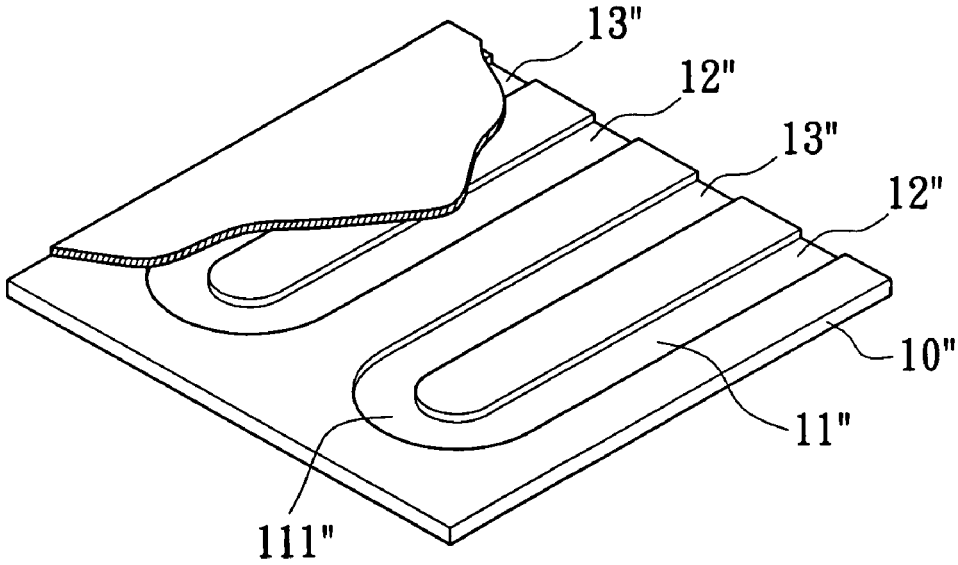
FIG. 3 is a perspective view of the water-cooling heat dissipation device adopted for modulized LEDs of a third embodiment according to the present invention.

FIGS. 1 to 3 illustrates various embodiments among the curved canal 11, the inlet 12 and the outlet 13. FIG. 1 showing the single curved canal 11 includes a plurality of bending portions 111, a single inlet 12 and a single outlet 13 are formed on opposite sides of the heat dissipation plate 10, and the inlet 12 and the outlet 13 communicate with two free ends of the curved canal 11, respectively. The quantities of the bending portions 111 can prolong the passing track of the heat-conductive liquid to increase heat dissipation efficiency. According to a second embodiment in FIG. 2, two inlets 12' and a single outlet 13' are formed on the same side of the heat dissipation plate 10'. The inlets 12' and the outlet 13' can alternatively communicate with the bending portion 111' or a free end of a single curved canal 11'. In this embodiment, the outlet 13' communicates with a bending portion 111', and the inlets 12' communicate with two free ends of the curved canal 11', so that the heat-conductive liquid can avoid passing along a longer track and thus decreasing the efficiency of heat dissipation. FIG. 3 shows an individual unit having two curved canals 11", a single inlet 12" and a single outlet 13" for achieving a shorter track and a higher capacity for heat dissipation as in the second embodiment. Furthermore, the heat dissipation plate 10" can control quantities of individual units to adjust the heat dissipation efficiency and further efficiency.

Figure 4:
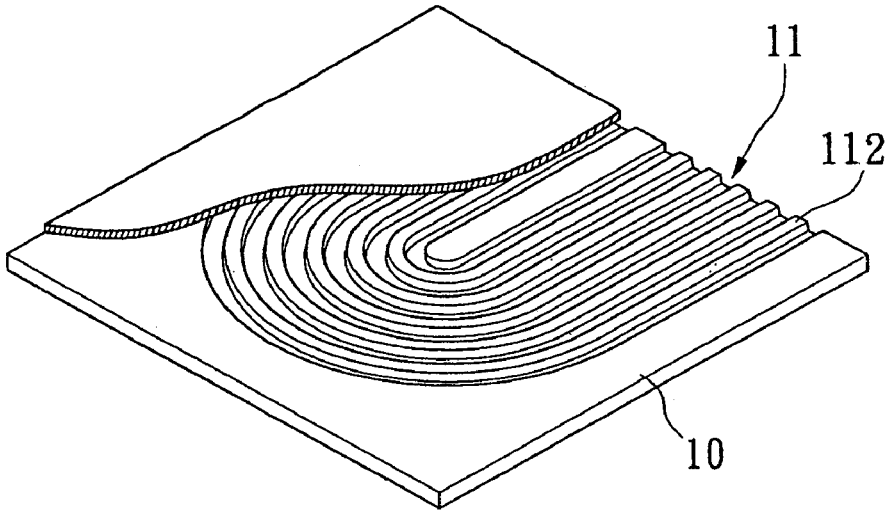
FIG. 4 is a perspective view of the water-cooling heat dissipation device adopted for modulized LEDs of a fourth embodiment according to the present invention.

Referring to FIG. 4, the water-cooling heat dissipation device 10 includes a plurality of interior fins 112 projecting in the curved canal 11. The interior fins 112 are shaped in elongated manners and parallel to one another, running in a parallel direction to the interior fins 112 along an extension direction of the curved canal 11. The interior fins 112 and the heat dissipation plate 10 can be made in one piece integrally. In this embodiment, the arrangement of the interior fins 112 can increase to the area of contact with the heat-conductive liquid, and the heat dissipation efficiency is thereby increased.

Figure 5:
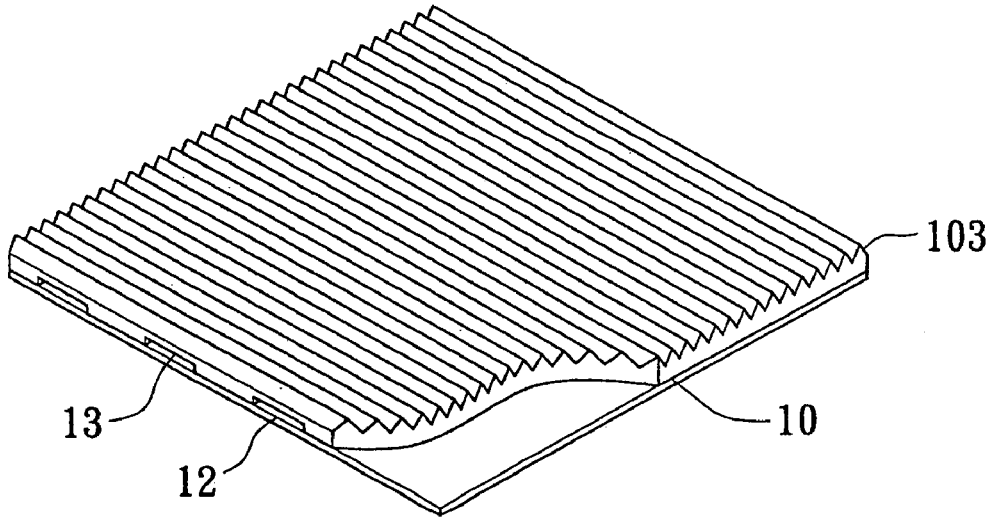
FIG. 5 is a perspective view of the water-cooling heat dissipation device adopted for modulized LEDs of a fifth embodiment according to the present invention.

FIG. 5 shows the heat dissipation plate 10 having a plurality of exterior fins 103 projecting from a bottom thereof for air-cooling. The exterior fins 103 are shaped in elongated manners and parallel to one another. The direction of the parallel exterior fins 103 is orthogonal to the inlet 12 and the outlet 13 alternatively, in order to carry the total heat from the total area, including the portion that the heat-conductive liquid does not pass along. The exterior fins 103 and the bottom of the heat dissipation plate 10 are made in one piece integrally.

Advantages of the present invention are summarized as follows:

1. The water-cooling heat dissipation device can resolve the heat problem of modulized LEDs effectively to avoid any decrease in luminance;
2. The water-cooling heat dissipation device uses the bending portion to prolong theroute of the heat-conductive liquid, so as to increase heat dissipation efficiency;
3. The water-cooling heat dissipation device uses the interior fins to increase the contact area of the heat-conductive liquid;
4. The water-cooling heat dissipation device uses the exterior fins to provide air cooling;
5. The water-cooling heat dissipation device uses various arrangements of the curved canal, the outlet and the inlet to vary units and combinations to increase heat dissipation efficiency; and
6. Embodiments mentioned above can be processed in the conventional process simply and easily without any further costs.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A water-cooling heat dissipation device adopted for a lighting module that includes a plurality of LEDs modulized together, the water-cooling heat dissipation device that operates as part of a system that includes a heat-conductive liquid, a liquid passing pipe, a heat exchanger and a pump, and the water-cooling heat dissipation device comprising:

a heat dissipation plate;

at least one curved canal recessed inside the heat dissipation plate and containing a heat-conductive liquid passing therein, the curved canal created as a part of the heat dissipation plate running laterally and including at least one bending portion arranged thereon;

at least one inlet formed on one of the sides of the heat dissipation plate selectively, and the inlet communicating with the bending portion and a free end of the curved canal in an alternative manner; and at least one outlet formed on one of the sides of the heat dissipation plate selectively, and the outlet communicating with the bending portion and a free end of the curved canal in an alternative manner;

wherein the lighting module contacts a top of the heat dissipation device directly;

wherein the heat dissipation plate includes a plurality of interior fins projecting in the curved canal.

2. The water-cooling heat dissipation device as claimed in claim 1, wherein the interior fins are shaped in an elongated manner and are parallel to one another, a parallel direction of the interior fins is along an extension direction of the curved canal.

3. The water-cooling heat dissipation device as claimed in claim 1, wherein the interior fins and the heat dissipation plate are made in one piece integrally.

* * * * *